US012004665B2

(12) United States Patent
Smith et al.

(10) Patent No.: US 12,004,665 B2
(45) Date of Patent: Jun. 11, 2024

(54) CONTAINER FOR PROVIDING AROMATIC SAMPLING AND VISUALIZATION OF CONTENTS

(71) Applicant: All Plastic, Inc., Rancho Cordova, CA (US)

(72) Inventors: William Thomas Smith, Fair Oaks, CA (US); Cheryl Ann Smith, Fair Oaks, CA (US)

(73) Assignee: All Plastic, Inc., Rancho Cordova, CA (US)

( * ) Notice: Subject to any disclaimer, the term of this patent is extended or adjusted under 35 U.S.C. 154(b) by 0 days.

(21) Appl. No.: 17/989,153

(22) Filed: Nov. 17, 2022

(65) Prior Publication Data

US 2023/0082067 A1 Mar. 16, 2023

Related U.S. Application Data

(63) Continuation of application No. 17/960,521, filed on Oct. 5, 2022, which is a continuation of application (Continued)

(51) Int. Cl.
*A47F 3/14* (2006.01)
*A47F 7/00* (2006.01)

(Continued)

(52) U.S. Cl.
CPC ..... *A47F 3/145* (2013.01); *A47F 7/0071* (2013.01); *A47F 7/0078* (2013.01); *A47F 7/286* (2013.01);

(Continued)

(58) Field of Classification Search
CPC ..... A45D 34/02; A47F 7/286; A47F 7/0078; A47F 7/0071; B65D 2201/00;

(Continued)

(56) References Cited

U.S. PATENT DOCUMENTS 386,604 A 7/1888 Place
D128,936 S 8/1941 Foley (Continued)

FOREIGN PATENT DOCUMENTS

CN 205821357 U 12/2016
CN 206212767 U 6/2017

(Continued)

OTHER PUBLICATIONS

Bud Bar Brochure. Sep. 29, 2011 [online]. Available: http://web.archive.org/web/20110725063930/http://www.budbardisplays.com/BudBarBrochure.pdf , 12 pages.

(Continued)

*Primary Examiner* — Nathan J Jenness
*Assistant Examiner* — Jennifer Castriotta
(74) *Attorney, Agent, or Firm* — Ballard Spahr LLP

(57) ABSTRACT

A display container includes (a) an enclosure having a container body and a lid mounted to the container body to enclose an interior chamber for storing botanical samples. The lid includes a lens defining an optical axis. The container body includes (i) an open top covered by the lid and defined by an opening, (ii) an interior base surface in the interior chamber and defined by an area smaller than that of the opening, the optical axis intersecting the base surface, and (iii) an interior sidewall surface sloping toward the base surface. The display container further includes (b) one or more scent ports extending through the lid, and (c) a port blocking member attached to the lid and movable between a closed position for blocking the scent ports and an open position for sampling an aroma of the botanical samples through the scent ports.

7 Claims, 18 Drawing Sheets

Related U.S. Application Data

No. 17/230,265, filed on Apr. 14, 2021, which is a continuation of application No. 16/502,168, filed on Jul. 3, 2019, now Pat. No. 11,001,413, which is a continuation of application No. 15/464,823, filed on Mar. 21, 2017, now Pat. No. 10,384,834, which is a continuation-in-part of application No. 14/701,961, filed on May 1, 2015, now Pat. No. 9,630,747.

(51) Int. Cl.

| | |
|---|---|
| ***A47F 7/28*** | (2006.01) |
| ***B65D 23/14*** | (2006.01) |
| ***B65D 25/10*** | (2006.01) |
| ***B65D 25/22*** | (2006.01) |
| ***B65D 25/54*** | (2006.01) |
| ***B65D 51/16*** | (2006.01) |
| ***B65D 51/24*** | (2006.01) |
| ***B65D 85/50*** | (2006.01) |

(52) U.S. Cl.

CPC ..... *B65D 23/14* (2013.01); *B65D 25/106* (2013.01); *B65D 25/22* (2013.01); *B65D 25/54* (2013.01); *B65D 51/1672* (2013.01); *B65D 51/1683* (2013.01); *B65D 51/24* (2013.01); *B65D 51/245* (2013.01); *B65D 85/50* (2013.01); *B65D 2201/00* (2013.01); *B65D 2203/02* (2013.01); *B65D 2203/12* (2013.01); *B65D 2501/24872* (2013.01)

(58) Field of Classification Search

CPC ..... B65D 47/32; B65D 25/54; B65D 47/121; B65D 85/52; B65D 85/50; B65D 85/505; B65D 85/70; B65D 2203/02; B65D 51/245; B65D 25/205; B65D 23/14; B65D 2501/24872; B65D 51/1683; B65D 51/1672; Y10S 261/88; Y10S 428/905; A01G 5/06; A47G 7/03

USPC ..... 206/730, 733, 734, 459.5; 220/367.1, 220/377, 231, 360, 361, 371, 372, 233, 220/DIG. 19; 40/649, 312; 402/71

See application file for complete search history.

(56) References Cited

U.S. PATENT DOCUMENTS

| | | | |
|---|---|---|---|
| 2,724,213 | A | 11/1952 | Weil |
| 2,765,194 | A | 10/1956 | Will |
| D181,321 | S | 10/1957 | Stowell, I |
| 2,807,901 | A | 10/1957 | Gilowitz |
| 3,018,024 | A | 1/1962 | Delbert |
| 3,247,995 | A | 4/1966 | Jensen |
| 3,451,328 | A | 6/1969 | Swett |
| 3,656,840 | A | 4/1972 | Smith et al. |
| 4,106,660 | A | 8/1978 | Boyle |
| D255,546 | S | 6/1980 | Zaidmann et al. |
| 4,230,231 | A | 10/1980 | Burnett et al. |
| 4,284,200 | A | 8/1981 | Bush et al. |
| 4,285,164 | A | 8/1981 | Moore |
| D272,595 | S | 2/1984 | Chase et al. |
| D289,143 | S | 4/1987 | Guillaume |
| D292,887 | S | 11/1987 | Schouten |
| D303,428 | S | 9/1989 | Wada et al. |
| 4,979,332 | A | 12/1990 | Nagaya et al. |
| D322,323 | S | 12/1991 | Moir |
| D323,674 | S | 2/1992 | Winslow |
| D340,187 | S | 10/1993 | Forsyth |
| 5,321,908 | A | 6/1994 | Ushimaru |
| 5,363,801 | A | 11/1994 | Wafters et al. |
| D364,093 | S | 11/1995 | Weaver, Jr. |
| 5,850,913 | A | 12/1998 | Fantone et al. |
| 5,927,007 | A | 7/1999 | Oda et al. |
| 6,013,524 | A | 1/2000 | Friars et al. |
| D455,552 | S | 4/2002 | Charness |
| 6,463,697 | B2 | 10/2002 | Weder et al. |
| 6,527,121 | B1 | 3/2003 | Flynn |
| 6,571,972 | B1 | 6/2003 | Bouc et al. |
| D476,572 | S | 7/2003 | Merritt |
| D480,307 | S | 10/2003 | Puigbo |
| 6,672,457 | B2 | 1/2004 | Aylesworth et al. |
| 6,761,287 | B2 | 7/2004 | Caruso |
| D493,721 | S | 8/2004 | Puigbo |
| D493,722 | S | 8/2004 | Cooper |
| D513,979 | S | 1/2006 | Snedden et al. |
| D517,405 | S | 3/2006 | Snedden et al. |
| D518,728 | S | 4/2006 | Frantz |
| D523,752 | S | 6/2006 | Bried et al. |
| 7,185,827 | B2 | 3/2007 | Quintard et al. |
| D547,177 | S | 7/2007 | Sherman et al. |
| D551,983 | S | 10/2007 | Barbagli |
| D570,648 | S | 6/2008 | Bodum |
| D588,450 | S | 3/2009 | Snedden et al. |
| D590,706 | S | 4/2009 | Wojciech |
| D591,148 | S | 4/2009 | Parikh |
| D600,111 | S | 9/2009 | Gerulski |
| 7,597,308 | B1 | 10/2009 | Stucki |
| D607,340 | S | 1/2010 | Klis |
| 7,644,536 | B2 | 1/2010 | Farhadi |
| D621,603 | S | 8/2010 | Traylor |
| 7,743,934 | B2 | 9/2010 | Martin |
| D630,949 | S | 1/2011 | Lim |
| D645,750 | S | 9/2011 | Lee |
| D646,969 | S | 10/2011 | Snedden |
| D647,530 | S | 10/2011 | Busch |
| 8,079,478 | B2 | 12/2011 | Short et al. |
| D655,604 | S | 3/2012 | Molina et al. |
| 8,166,701 | B1 | 5/2012 | Duff, Sr. |
| D671,831 | S | 12/2012 | Moreau |
| D685,227 | S | 7/2013 | Boonprasop |
| 8,528,775 | B2 | 9/2013 | Martin |
| 8,544,208 | B2 | 10/2013 | Huang |
| D696,948 | S | 1/2014 | Kim |
| D702,547 | S | 4/2014 | Akana et al. |
| D703,055 | S | 4/2014 | Park |
| D716,099 | S | 10/2014 | Farber et al. |
| 8,899,443 | B2 | 12/2014 | Soibel et al. |
| 8,925,725 | B1 | 1/2015 | Burnett |
| D731,891 | S | 6/2015 | Servaire |
| D737,503 | S | 8/2015 | Now |
| D749,381 | S | 2/2016 | Magri |
| 9,334,086 | B2 | 5/2016 | Bean et al. |
| D765,389 | S | 9/2016 | Martin |
| D769,079 | S | 10/2016 | Kotani |
| D775,959 | S | 1/2017 | Owen et al. |
| D778,718 | S | 2/2017 | Smith et al. |
| 9,630,747 | B2 | 4/2017 | Smith et al. |
| D786,082 | S | 5/2017 | Kachar et al. |
| D794,944 | S | 8/2017 | Martin |
| 9,801,488 | B2 | 10/2017 | Affatato et al. |
| D803,287 | S | 11/2017 | Whetsel et al. |
| D804,093 | S | 11/2017 | Chen |
| D806,543 | S | 1/2018 | Finkbohner et al. |
| D812,939 | S | 3/2018 | Moldin |
| D814,105 | S | 3/2018 | Eng et al. |
| D814,831 | S | 4/2018 | Modlin |
| 9,981,790 | B1 | 5/2018 | Ost et al. |
| D821,738 | S | 7/2018 | Small |
| D830,779 | S | 10/2018 | Li |
| 10,179,694 | B2 | 1/2019 | Fenner, Jr. |
| D842,494 | S | 3/2019 | Lee |
| D849,526 | S | 5/2019 | Sanders |
| D855,449 | S | 8/2019 | Smith et al. |
| 10,384,834 | B2 | 8/2019 | Smith et al. |
| D859,894 | S | 9/2019 | Smith et al. |
| D861,475 | S | 10/2019 | Giwani |
| D862,226 | S | 10/2019 | Horn |
| D863,053 | S | 10/2019 | Smith et al. |
| D866,334 | S | 11/2019 | Wieland et al. |
| D876,945 | S | 3/2020 | Smith et al. |
| D877,930 | S | 3/2020 | Santamarta |
| D878,120 | S | 3/2020 | Smith et al. |

(56) References Cited

U.S. PATENT DOCUMENTS

| | | | |
|---|---|---|---|
| D878,826 | S | 3/2020 | Smith et al. |
| D878,827 | S | 3/2020 | Smith et al. |
| D887,843 | S | 6/2020 | Smith et al. |
| D902,028 | S | 11/2020 | Smith et al. |
| D902,718 | S | 11/2020 | Smith et al. |
| 11,001,413 | B2 | 5/2021 | Smith et al. |
| 2003/0234208 | A1 | 12/2003 | Huang |
| 2004/0211746 | A1 | 10/2004 | Trude |
| 2005/0092751 | A1 | 5/2005 | Alvares et al. |
| 2007/0051826 | A1 | 3/2007 | Schofield |
| 2008/0308559 | A1 | 12/2008 | Peleg et al. |
| 2009/0057326 | A1 | 3/2009 | Opitz |
| 2009/0261100 | A1 | 10/2009 | McMinn |
| 2010/0300370 | A1 | 12/2010 | Hundt |
| 2013/0280147 | A1 | 10/2013 | Kang |
| 2013/0313217 | A1 | 11/2013 | Yamamoto et al. |
| 2014/0069007 | A1 | 3/2014 | Chen et al. |
| 2015/0166257 | A1 | 6/2015 | Trombetta |
| 2015/0191279 | A1 | 7/2015 | Price |
| 2015/0298136 | A1 | 10/2015 | Dukat |
| 2015/0313095 | A1 | 11/2015 | Fenner, Jr. |
| 2016/0031605 | A1 | 2/2016 | Bean et al. |
| 2016/0128513 | A1 | 5/2016 | Chan |
| 2017/0275053 | A1 | 9/2017 | Wartersian et al. |
| 2017/0275075 | A1 | 9/2017 | Bamonte et al. |
| 2018/0242529 | A1 | 8/2018 | Tian et al. |
| 2018/0362215 | A1 | 12/2018 | Whetsel et al. |
| 2019/0009967 | A1 | 1/2019 | Lung |
| 2019/0152648 | A1 | 5/2019 | Parve et al. |
| 2020/0113353 | A1 | 4/2020 | Bigioni et al. |
| 2020/0130901 | A1 | 4/2020 | Karll |

FOREIGN PATENT DOCUMENTS

| | | | |
|---|---|---|---|
| CN | 206273085 | U | 6/2017 |
| CN | 206596415 | U | 10/2017 |
| CN | 206776505 | U | 12/2017 |
| EP | 0990408 | | 9/2003 |
| EP | 990408 | B1 | 9/2003 |
| EP | 1779885 | | 5/2007 |
| KR | 200357151 | Y1 | 7/2004 |
| KR | 2020110007691 | U | 8/2011 |
| KR | 1020120103019 | A | 9/2012 |
| KR | 101215203 | | 12/2012 |

OTHER PUBLICATIONS

Canna-Pod. Jul. 2, 2014 [online]. Available: https://web.archive.org/web/20140702032541/http://budbardisplays.com/bud_pods.htm, 6 pages.

Pictures of Bud Bar Displays™ booth at the KushCon Convention, which features the Epods. Denver, Colorado, Dec. 1, 2010. 3 pages.

Pictures of Bud Bar Displays™ booth at the KushCon Convention, which features the Bud Pod. Denver, Colorado, Dec. 1, 2010. 3 pages (color).

Website photo. Epod. www.budbardisplays.com. Published Jul. 1, 2013.

CONTAINER FOR PROVIDING AROMATIC SAMPLING AND VISUALIZATION OF CONTENTS

CROSS-REFERENCE TO RELATED APPLICATIONS

This application is a continuation of and claims priority to U.S. patent application Ser. No. 17/960,521, filed Oct. 5, 2022, which is a continuation of and claims priority to U.S. patent application Ser. No. 17/230,265, filed Apr. 14, 2021, which is a continuation of and claims priority to U.S. application Ser. No. 16/502,168 filed Jul. 3, 2019, which application is a continuation of and claims priority to U.S. patent application Ser. No. 15/464,823 filed Mar. 21, 2017, now U.S. Pat. No. 10,384,834; which application is a continuation in part of and claims priority to U.S. patent application Ser. No. 14/701,961 filed May 1, 2015, now U.S. Pat. No. 9,630,747, issued Apr. 25, 2017, each of which is incorporated by reference herein in its respective entirety and mad e part of this specification.

FIELD OF THE INVENTION

Display containers are known in the prior art. Customers commonly wish to visualize contents contained within a display container, and on some occasions, visualize contents under magnification. Further, prospective purchasers frequently wish to test the aroma of contained contents for suitability, freshness, or other features. For example, customers wishing to purchase tea may wish to inspect leaves and sample the aroma. Further, purchasers of legally available cannabis commonly wish to inspect the botanical product in detail and sample aroma. Such display containers that permit adequate storage, preservation, and presentation of botanical samples, such as cannabis, are not adequately described or available.

SUMMARY

Aspects of the present invention disclose and describe a container for displaying, visualizing, and aroma sampling botanical materials—such as tea, cannabis, and the like. Aspects of the present invention further disclose a container permitting stabilization and magnification of a portion of a sample material—such as a botanical sample.

DRAWINGS

DESCRIPTION

Figure 1:
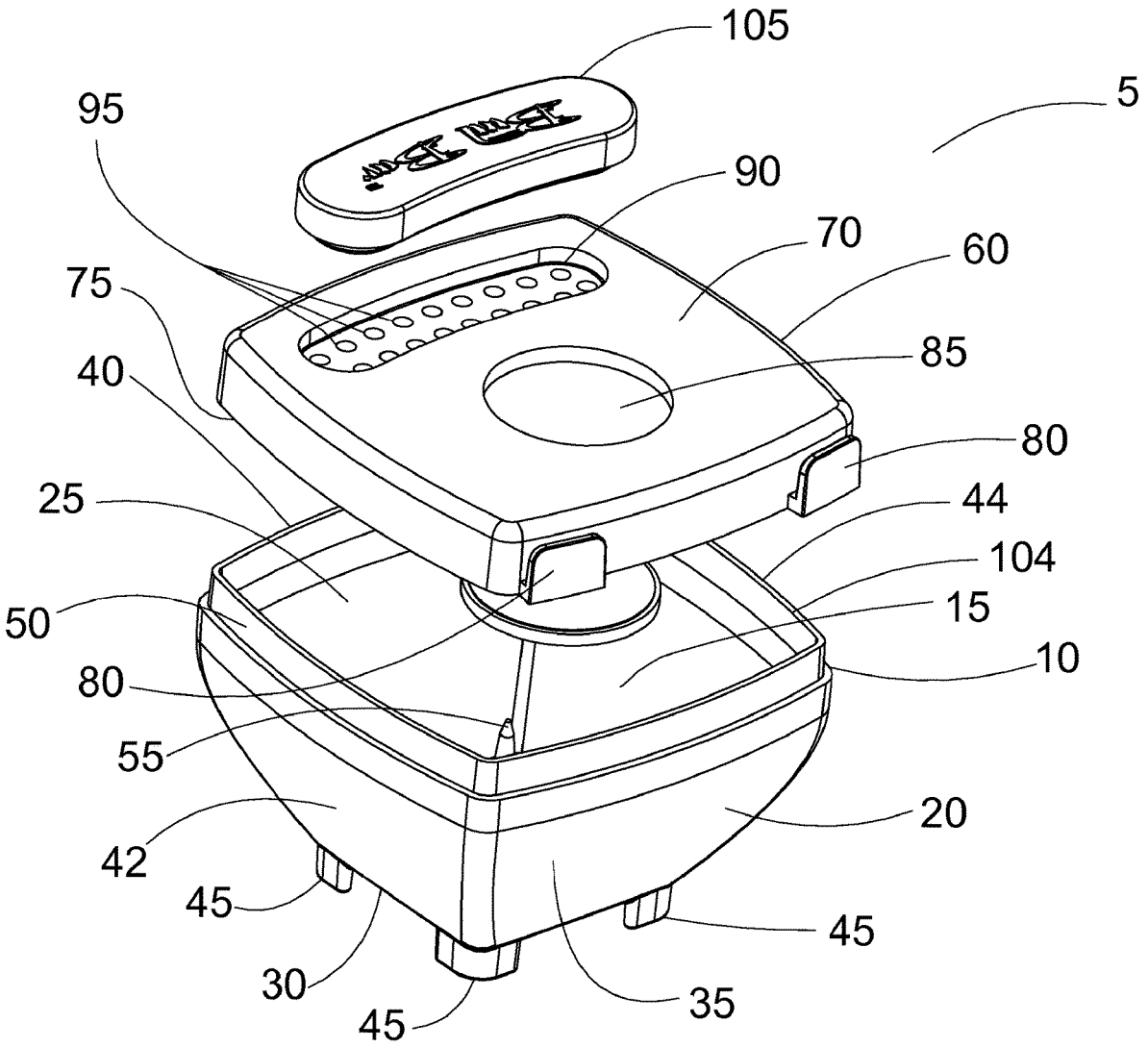
FIG. 1 is an exploded perspective view of an embodiment of the present invention.

Turning now to FIG. 1, container 5 comprises, a container body 10 having an interior surface 15 and exterior surface 20. Container body 10 is shaped to define an open top 25, a bottom 30, a front 35, a back 40, a first side 42, a second side 44, and a plurality of feet 45. Container body 10 is further shaped to define a perimetrical ridge 50 surrounding said open top 25. A portion of the container body 10 is shaped to define mounting projection 55 to hold a subject sample such as a botanical sample.

Lid 60 has an interior lid surface 65 (FIG. 7) and exterior lid surface 70. Lid 60 is shaped to define a perimeter 75, and optionally further shaped to define at least one projection 80 disposed on a portion of said exterior surface 70 of said lid 60. One or more projection 80 functions as a card holder to provide information on the sample within container body. Optionally, projection 80 is omitted and informational material is presented within container body—such as a portion of container body 10 shaped to define a card holder within container body 10. Lid 60 is further shaped to define a viewing opening 85. Lid 60 is further shaped to define a recessed area 90, and further shaped to define a plurality of scent openings 95 within said recessed area 90. In one example embodiment, scent openings are about 0.125 inches in diameter and arranged in two rows. Removable plug 105 shaped to fit within recessed area 90 forming an airtight seal. In one embodiment, the recessed area and removable plug are omitted, and scent holes are located flush on the surface of lid 60, and optionally scent hole patency is adjustable.

Figure 7:
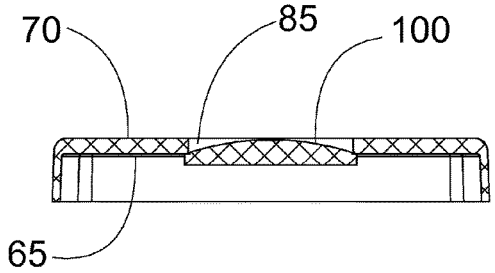
FIG. 7 is a cross-sectional view taken through line 7-7 of FIG. 6.

Turning to FIG. 7, Lens 100 disposed to cover said viewing opening 85. Lens 100 may be affixed to lid 60 by snap fit, or friction fit or adhesively. Lens 100 covers viewing opening 85. Lens 100 forms an airtight seal between lens 100 and said lid 60. In a preferred embodiment, lens 100 is adhesively affixed within viewing opening 85. In one embodiment, lens 100 is a plano-convex lens such as Lens #90-1235 manufactured by J. P. Manufacturing. A variety of lenses may be used such as a 1×, 2×, or 3× magnifier. In an alternative embodiment, the lens is not a magnifier.

Figure 8:
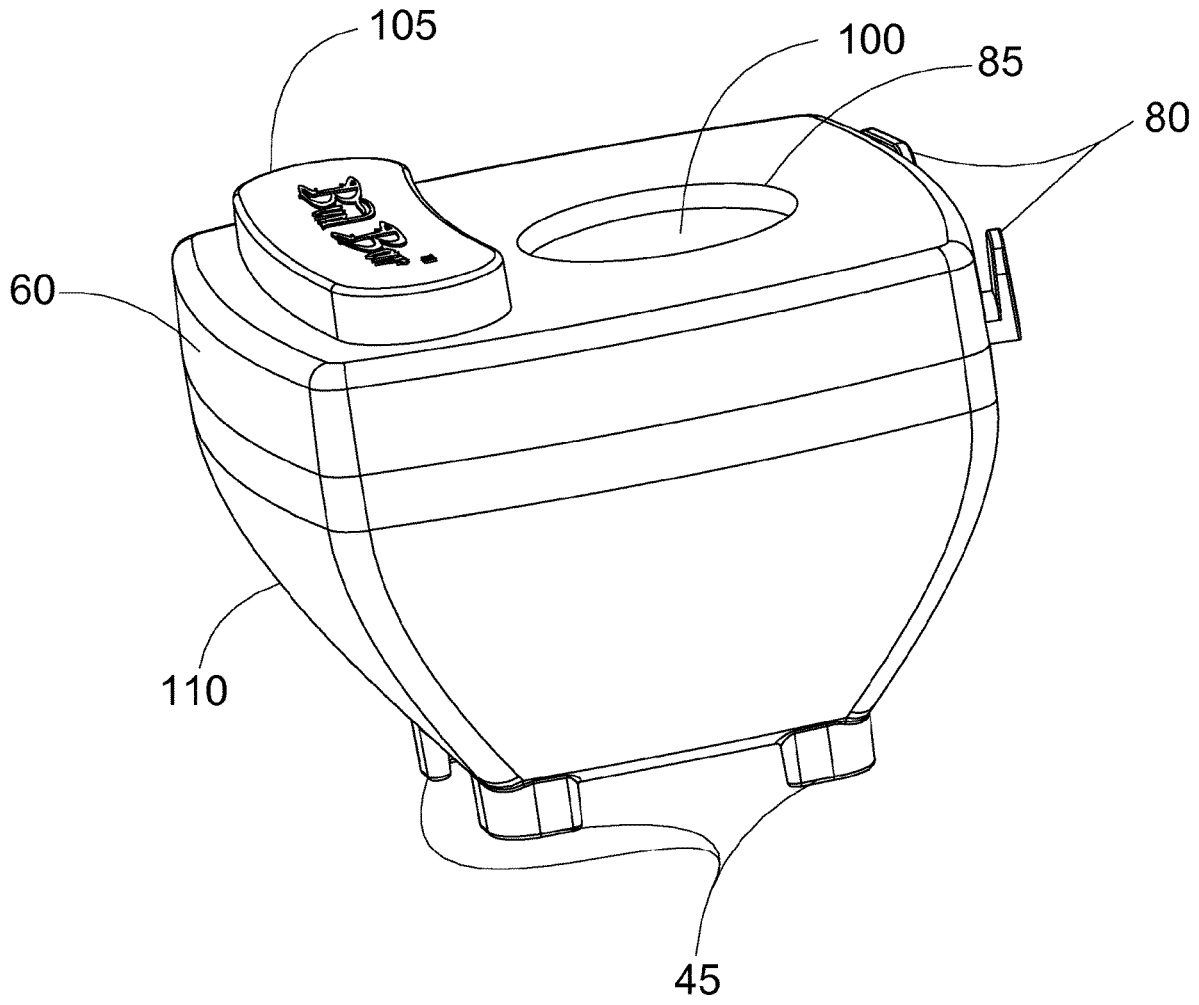
FIG. 8 is a perspective view of an embodiment of the present invention.
Figure 9:
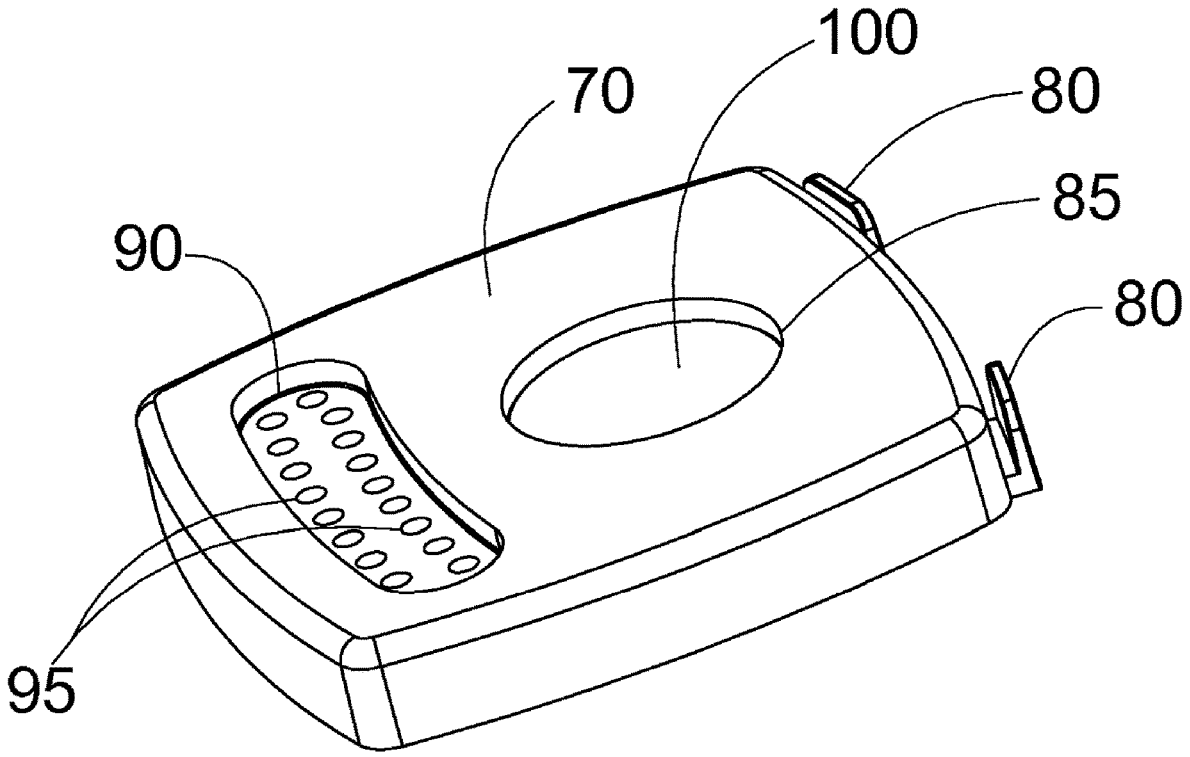
FIG. 9 is a perspective view of an embodiment lid of the present invention.

Turning to FIG. 8, Lid 60 is fitted on the perimetrical ridge 50 of said container body 10 forming an airtight chamber 110, wherein said plug 105 forms an airtight seal between plug 105 and recessed area 90 of said lid 60 completely sealing chamber 110. In one embodiment, plug 105 is comprised of soft material such as soft rubber or silicone. Lid 60 is further illustrated by FIG. 9.

Figure 2:
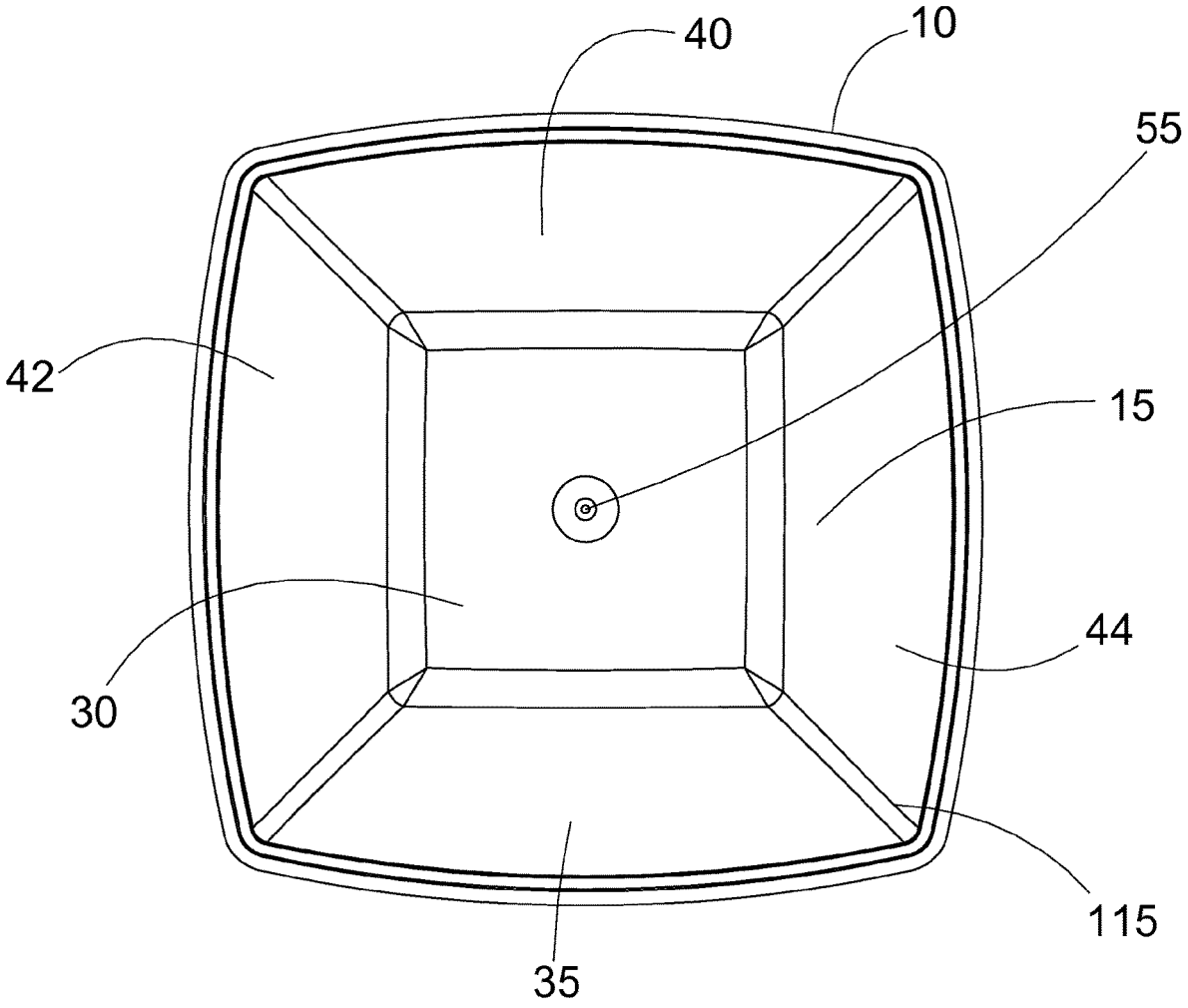
FIG. 2 is a top view of an embodiment container body of the present invention.

FIG. 2 illustrates a top view of container body 10 showing interior surface 15. It should be noted that in one embodiment, corners 115 between container body 10 front 35, a back 40, a first side 42, a second side 44, are rounded, yet in an alternative embodiment corners may be relatively sharp.

Figure 3:
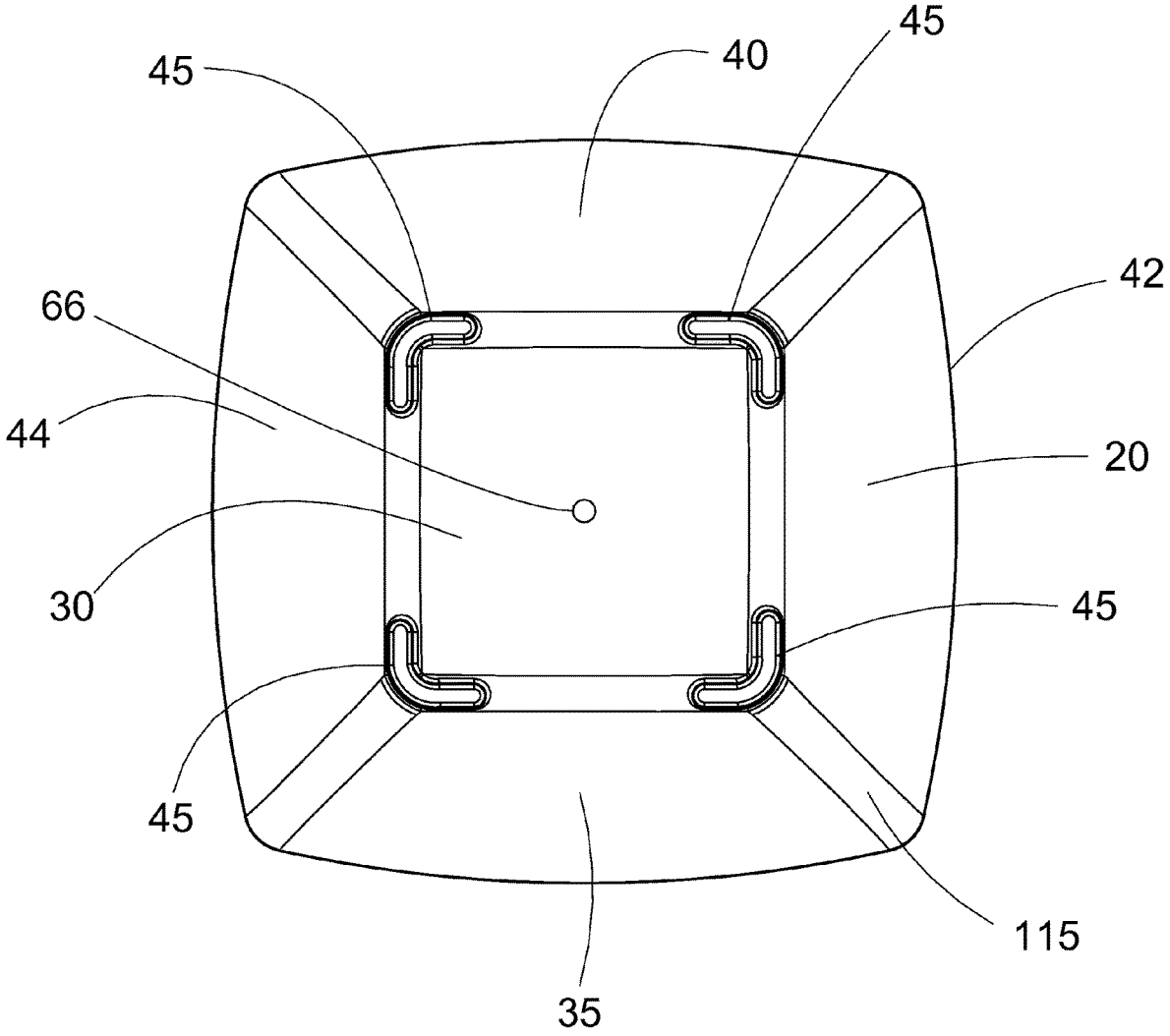
FIG. 3 is a bottom view of an embodiment container body of the present invention.
Figure 10:
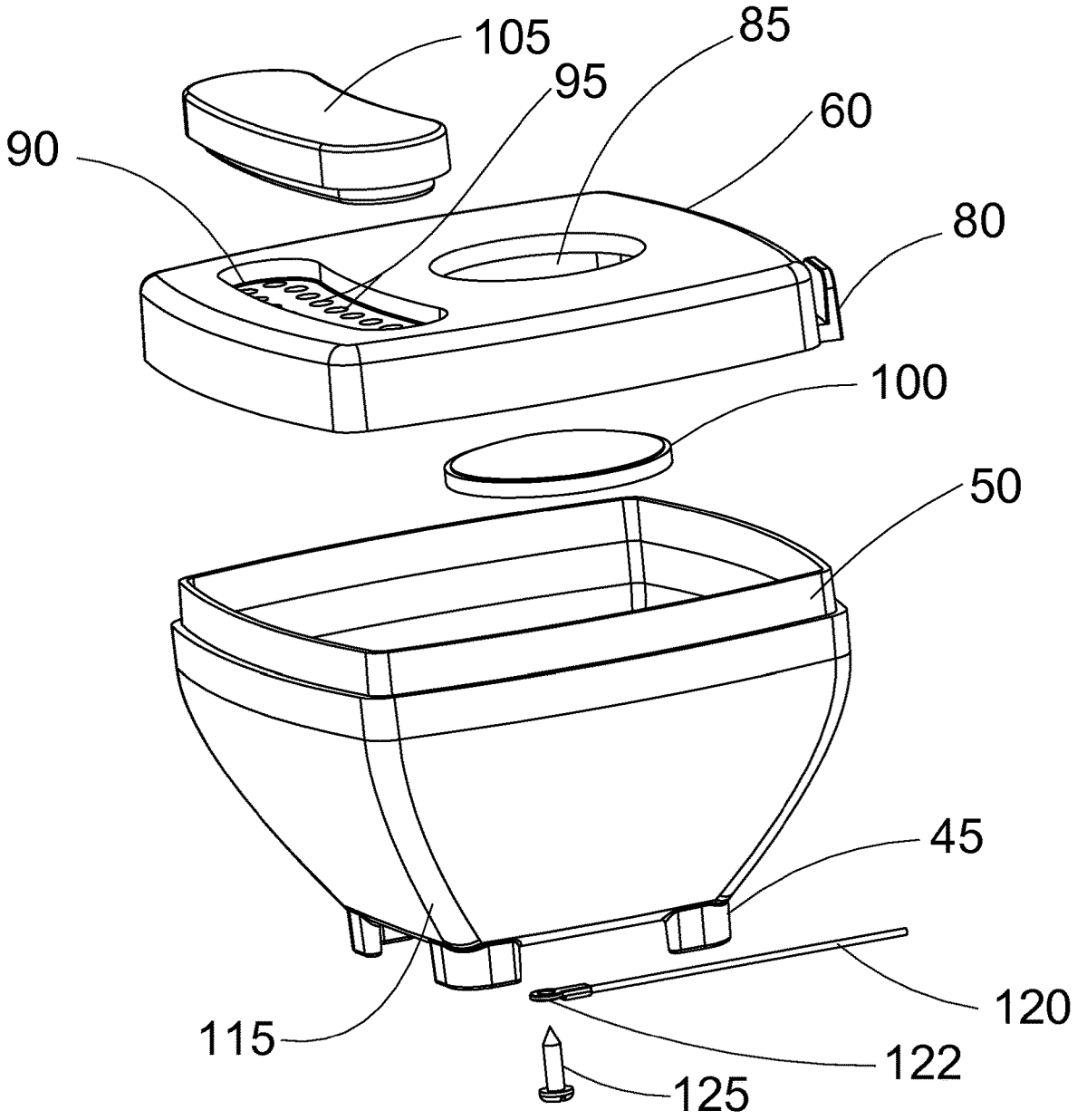
FIG. 10 is an exploded view of an embodiment of the present invention.
Figure 11:
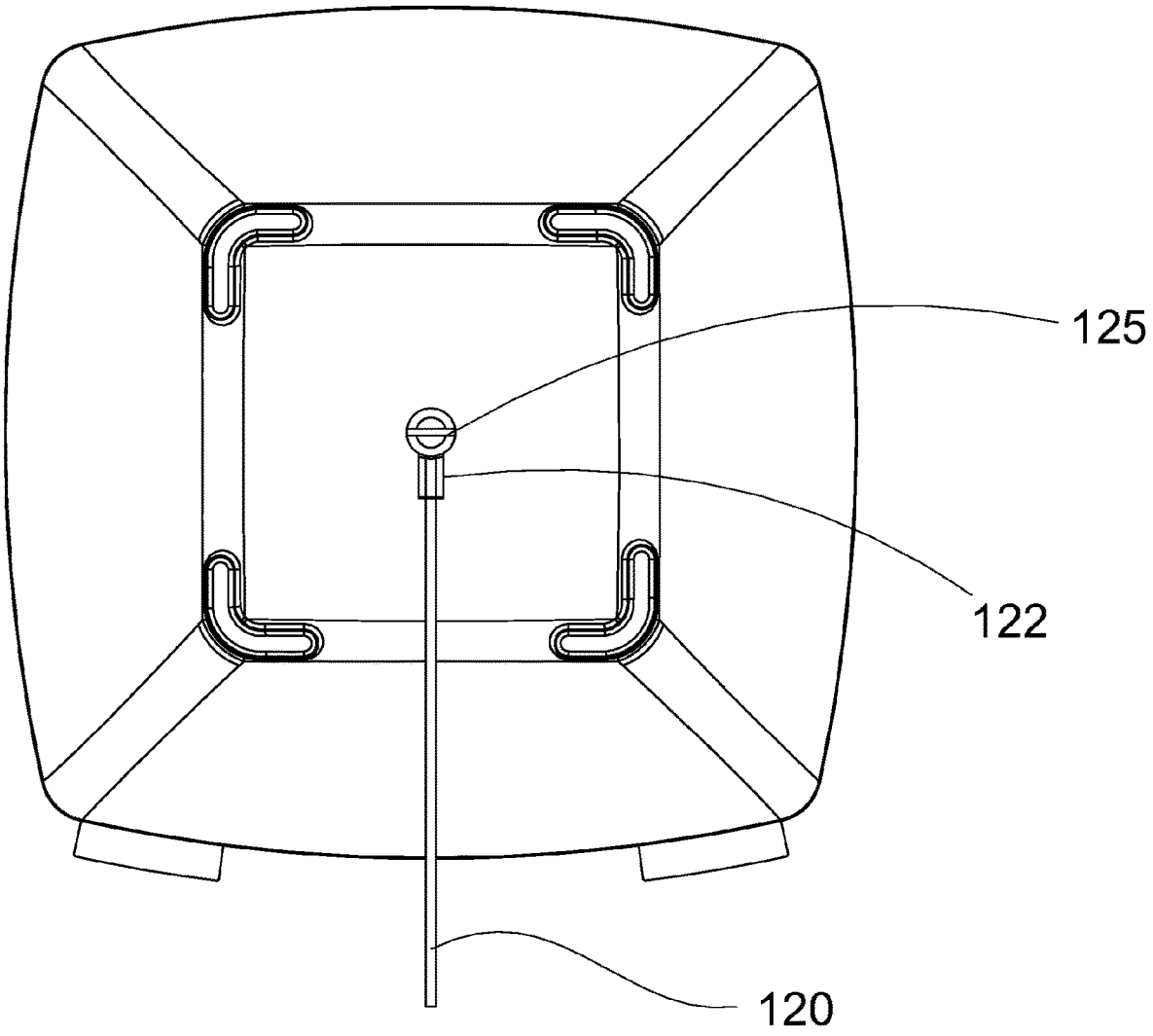
FIG. 11 is a bottom view of an embodiment container body and embodiment tether.

FIG. 3 illustrates a bottom view of container body 10 showing exterior surface 20. In one embodiment, bottom 30 is flat, in another embodiment, container body 10 bottom may be convex or concave. In a preferred embodiment, bottom 30 is flat and feet 45 allow container body 10 to be set on a flat resting surface where bottom 30 is not in contact with the flat surface. Mounting recess 66 allows an optional tether 120 to be affixed to the apparatus (FIGS. 10-11). In one embodiment, illustrated by FIGS. 10-11, tether 120 terminates in eyelet 122. Eyelet 122 is affixed to container 5 by screw 125 which passes through eyelet 122 and tapped into recess 66 thereby holding eyelet 122 and tether 120 in place. Tether 120 allows apparatus 5 to be carried by tether. Apparatus 5 may be rested on a flat surface with tether 120 in place because feet 45 provide sufficient clearance between the eyelet and the flat resting surface.

Figure 4:
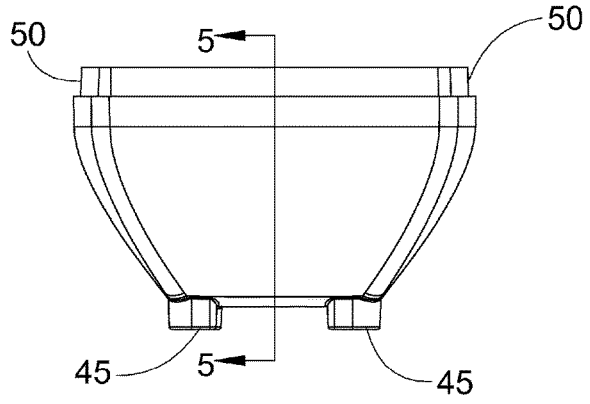
FIG. 4 is a side elevation view of an embodiment container body of the present invention.

FIG. 4 illustrates a side elevation view illustrating feet 45 and perimetrical ridge 50.

Figure 5:
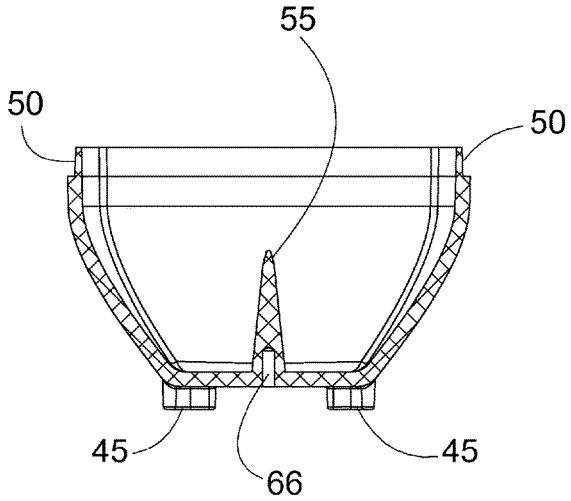
FIG. 5 is a cross-sectional view taken through line 5-5 of FIG. 4.
Figure 6:
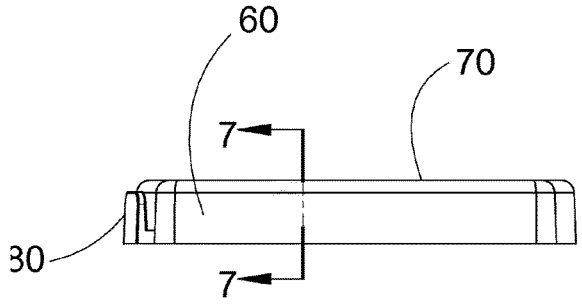
FIG. 6 is a side elevation view of an embodiment lid of the present invention.

FIG. 5 is a sectional view taken through line 5-5 of FIG. 4, illustrating a section of mounting spike 55 and recess 66 within. FIG. 6 is a side elevation view of lid 60 demonstrating exterior lid surface 70 and projection 80. FIG. 7 is a sectional view taken through line 7-7 of FIG. 6. Lens 100 is shown within viewing opening 85. In one preferred embodiment, lens 100 is countersunk within viewing opening 85. In an alternative, lens 100 may be domed above viewing opening 85. Lens 100 may be mounted on or within viewing opening 85 in any fashion permitting visualization through viewing opening 85. In one embodiment, lens 100 may be replaced with a window which provides viewing but lacks magnification power.

In use, a botanical sample, such as a sample of cannabis, is selected and placed within container body 10. A portion of the sample may be mounted on mounting projection 55. In one example, the end of mounting projection 55 is relatively sharp and capable of piercing a botanical sample—such as a botanical sample of cannabis. The sample is held on projection 55 due to frictional contact with the sample and aided by the sticky nature of the resin. Lid 60 engages perimetrical ridge 50 container body 10 fastening lid 60 and container body 10 together to form chamber 110. Plug 105 is inserted within recessed area 90 to seal the plurality of scent openings 95 to make chamber 110 airtight. An identification card, bearing information about the botanical product, may be secured by two projections 80. Turning to FIGS. 10 and 11, an optional, tether 120 may be affixed as described above. In one embodiment, such a tether may be a lanyard worn about the neck. In another embodiment, tether 125 may be retractable. Tether 125 may be affixed by other means—screw 125 and eyelet 122 providing only an example. The above example of use applies to container bodies of all shapes described herein, which may or may not include mounting projection 55. If the container does not include a mounting projection, the botanical sample would rest on the internal surface of the container.

Container body 10 and lid 60, and any container body and lid described herein, may be formed by injection molding and comprised of Poly(methyl methacrylate) (PMMA). Alternatively, container body 10 and lid 60 may be comprised of Styrene Acrylonitrile resin (SAN) or polycarbonate plastic. Container body 10 and lid 60 may be comprised of any moldable material. Container body 10 and lid 60 may be transparent, translucent or opaque—depending on the specimen to be contained within.

Container 5, and other containers and container bodies described herein, may be used for a variety of purposes. For example the inventive apparatus may be used as an entomological storage display. In an alternative, mounting projection 55 may be outfitted with one or more pins, clips, fasteners, prong holder, or adhesive contacts to prepare and display specimens. Further, the present invention is of use for storage, presentation and display of many other items where magnification of the sample or product is desired. For example, projection 55 may be modified to hold other collectable collectible items such as coins, stamps, or jewelry. It these embodiments, lid 60 will be optional shaped without a recessed area or scent holes, or shaped to provide an opening for ventilation. In one embodiment, lid 60 provides user-adjustable ventilation.

Figure 12:
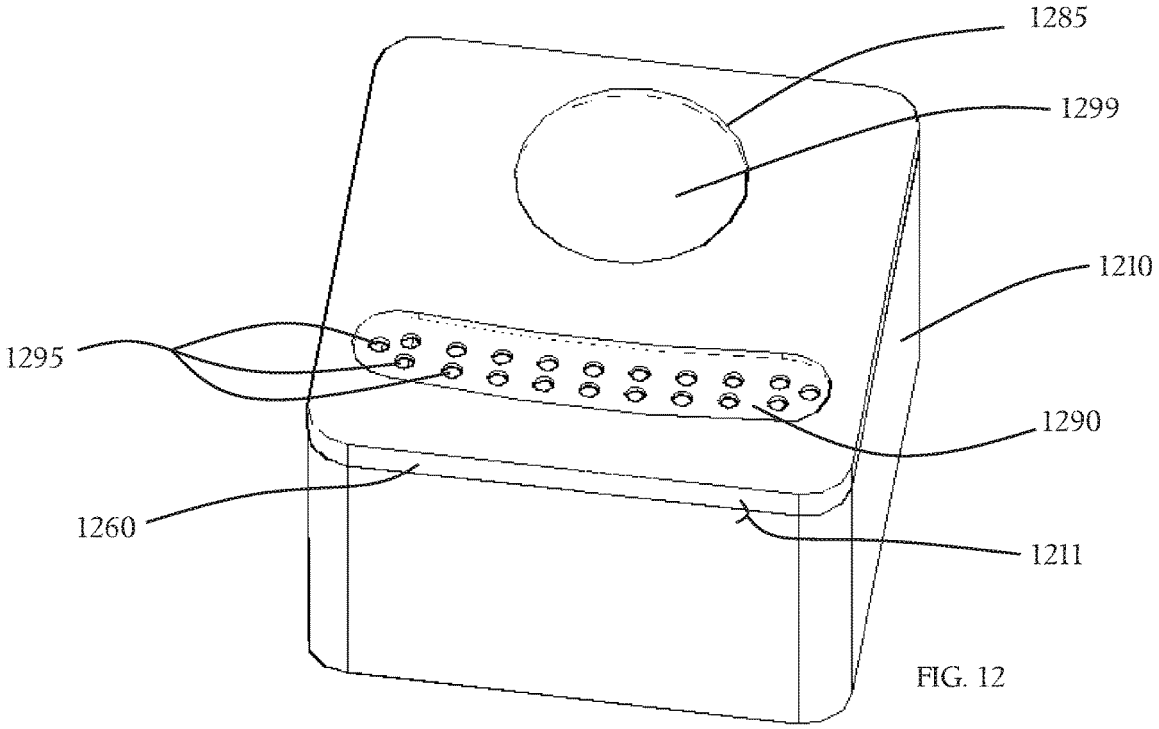
FIG. 12 is a perspective view of an embodiment square container body.
Figure 13:
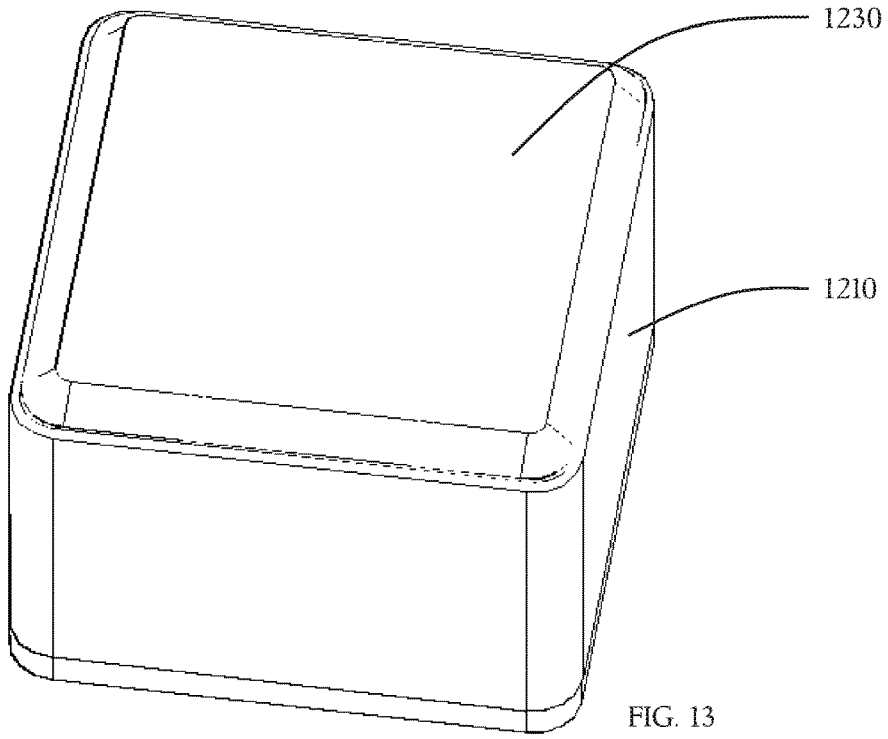
FIG. 13 is a bottom perspective view of an embodiment square container body.

FIG. 12 illustrates a container body 1210 shaped to define a square having a bottom surface 1230 (illustrated by FIG. 13). Lens 1299 is shown within viewing opening 1285. In one preferred embodiment, lens 1299 is countersunk within viewing opening 1285. In an alternative, lens 1299 may be domed above viewing opening 1285. Lens 1299 may be mounted on or within viewing opening 1285 in any fashion permitting visualization through viewing opening 1285. In one embodiment, lens 1299 may be replaced with a window which provides viewing but lacks magnification power. Lid 1260 fits snugly on container body 1210 forming an airtight seal, defining chamber 1211. Plug 105, illustrated by FIGS. 1, 8, and 10, is inserted within recessed area 1290 to seal the plurality of scent openings 1295 to make chamber 1211 airtight.

Figure 14:
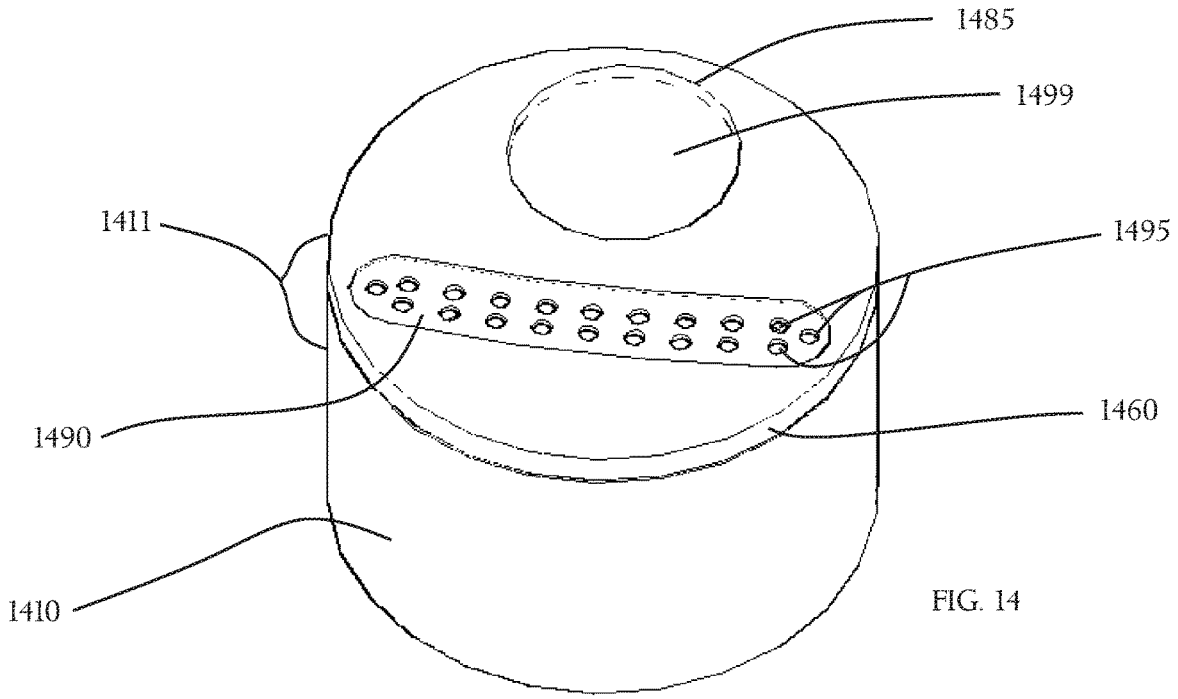
FIG. 14 is a perspective view of an embodiment round container body.
Figure 15:
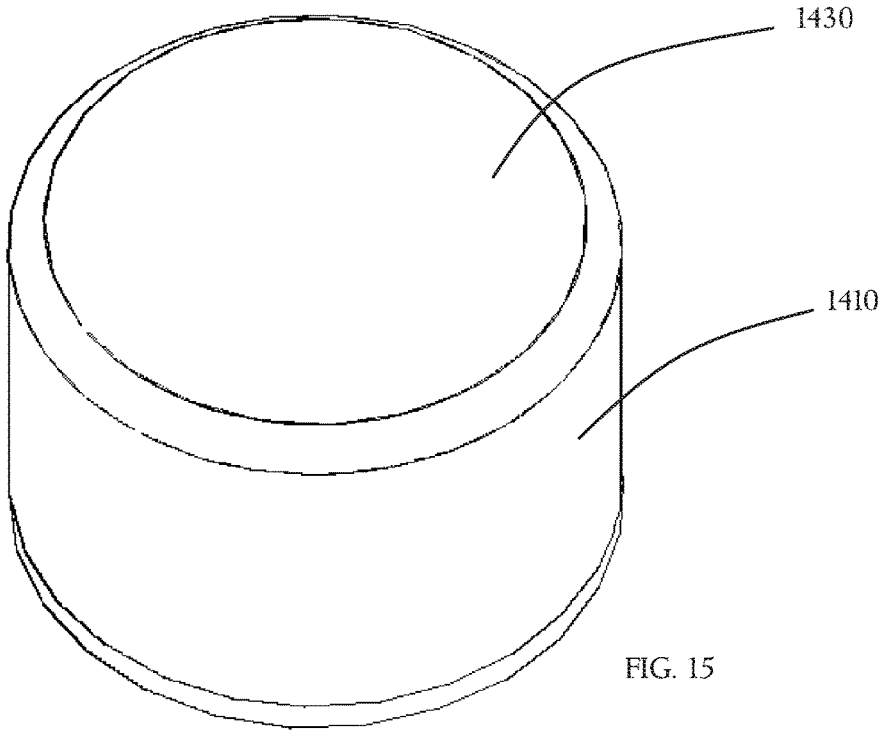
FIG. 15 is a bottom perspective view of an embodiment round container body.

FIG. 14 illustrates a round embodiment container body 1410 having a bottom surface 1430 (illustrated by FIG. 15). Lens 1499 is shown within viewing opening 1485. In one preferred embodiment, lens 1499 is countersunk within viewing opening 1485. In an alternative, lens 1499 may be domed above viewing opening 1485. Lens 1499 may be mounted on or within viewing opening 1485 in any fashion permitting visualization through viewing opening 1485. In one embodiment, lens 1499 may be replaced with a window which provides viewing but lacks magnification power. Lid 1460 fits snugly on container body 1410 forming an airtight seal, defining chamber 1411. Plug 105, illustrated by FIGS.

1, 8, and 10, is inserted within recessed area 1490 to seal the plurality of scent openings 1495 to make chamber 1410 airtight.

Figure 16:
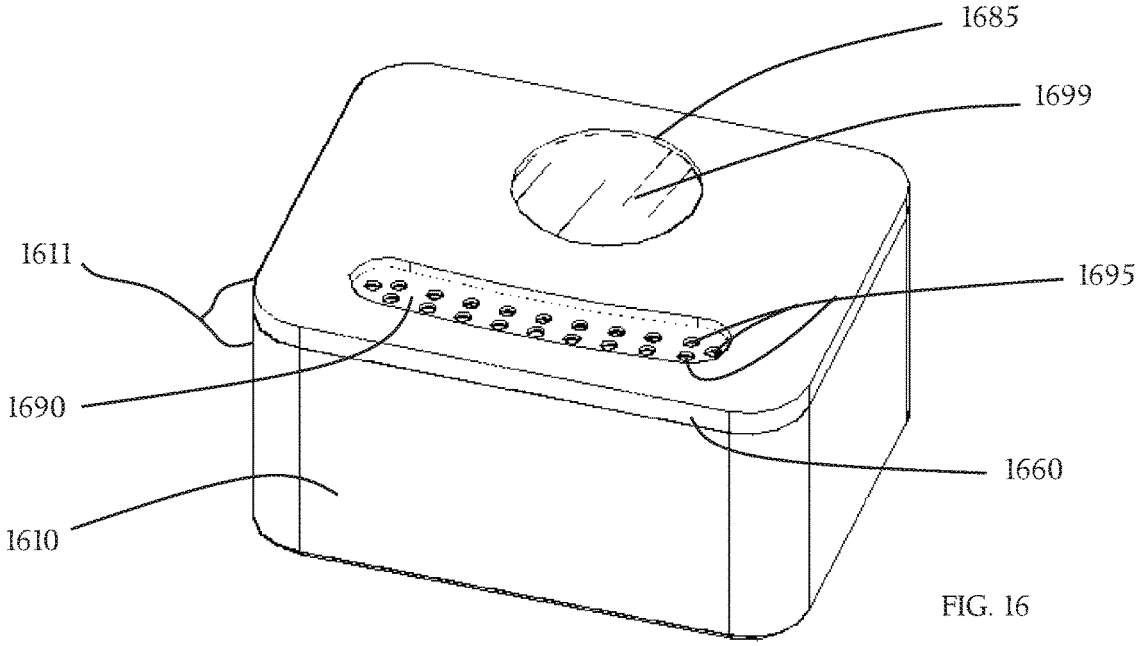
FIG. 16 is a perspective view of an embodiment rectangle container body.
Figure 17:
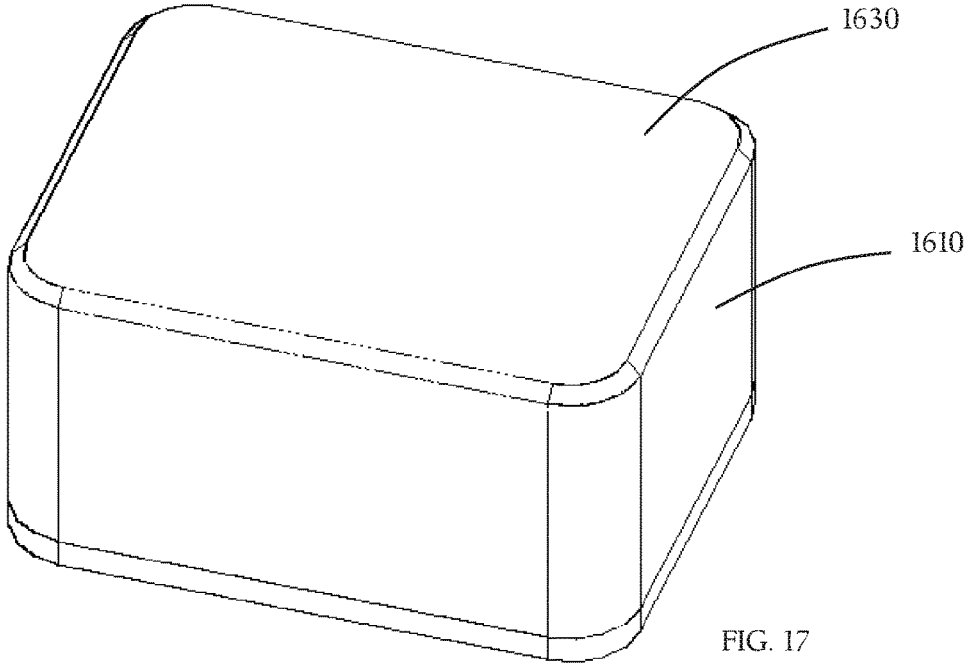
FIG. 17 is a bottom perspective view of an embodiment rectangle container body.

FIG. 16 illustrates a substantially rectangularly shaped embodiment container body 1610 having a bottom surface 1630 (illustrated by FIG. 17). Lens 1699 is shown within viewing opening 1685. In one preferred embodiment, lens 1699 is countersunk within viewing opening 1685. In an alternative, lens 1699 may be domed above viewing opening 1685. Lens 1699 may be mounted on or within viewing opening 1685 in any fashion permitting visualization through viewing opening 1685. In one embodiment, lens 1699 may be replaced with a window which provides viewing but lacks magnification power. Lid 1660 fits snugly on container body 1610 forming an airtight seal, defining chamber 1611. Plug 105, illustrated by FIGS. 1, 8, and 10, is inserted within recessed area 1690 to seal the plurality of scent openings 1695 to make chamber 1611 airtight.

Figure 18:
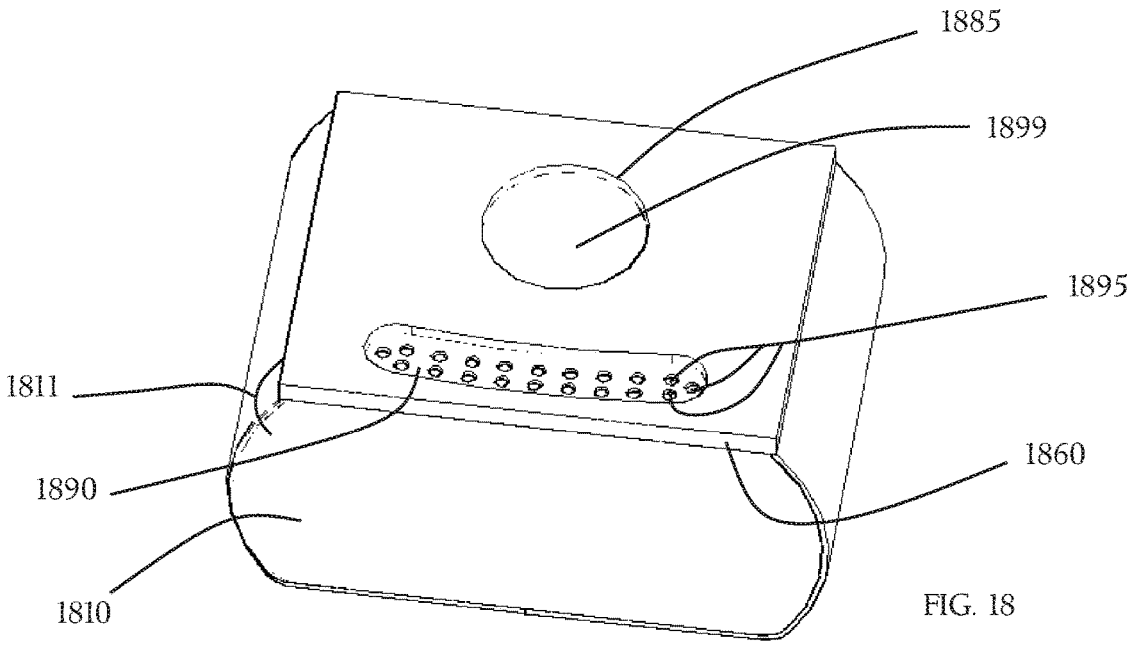
FIG. 18 is a perspective view of an embodiment oval cross-section container body.
Figure 19:
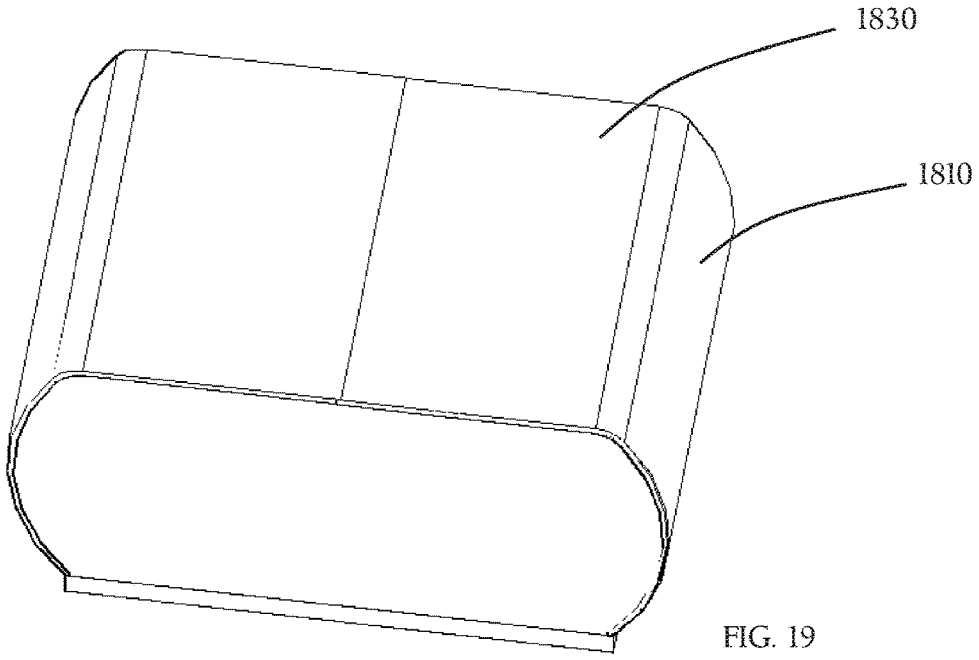
FIG. 19 is a bottom perspective view of an embodiment oval cross-section container body.

FIG. 18 illustrates an oval cross-section shaped embodiment container body 1810 having a bottom surface 1830 (illustrated by FIG. 19). Lens 1899 is shown within viewing opening 1885. In one preferred embodiment, lens 1899 is countersunk within viewing opening 1885. In an alternative, lens 1899 may be domed above viewing opening 1885. Lens 1899 may be mounted on or within viewing opening 1885 in any fashion permitting visualization through viewing opening 1885. In one embodiment, lens 1899 may be replaced with a window which provides viewing but lacks magnification power. Lid 1860 fits snugly on container body 1810 forming an airtight seal, defining chamber 1811. Plug 105, illustrated by FIGS. 1, 8, and 10, is inserted within recessed area 1890 to seal the plurality of scent openings 1895 to make chamber 1811 airtight.

Figure 20:
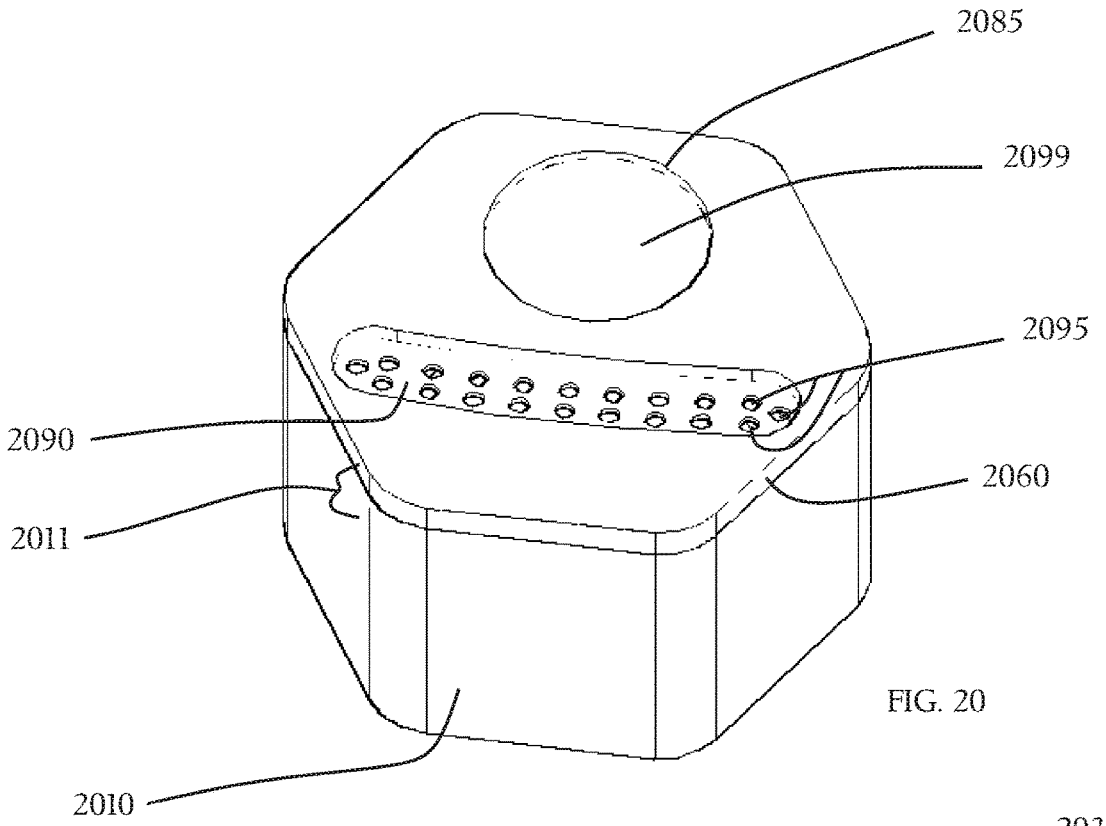
FIG. 20 is a perspective view of a first embodiment hexagonal container body.
Figure 21:
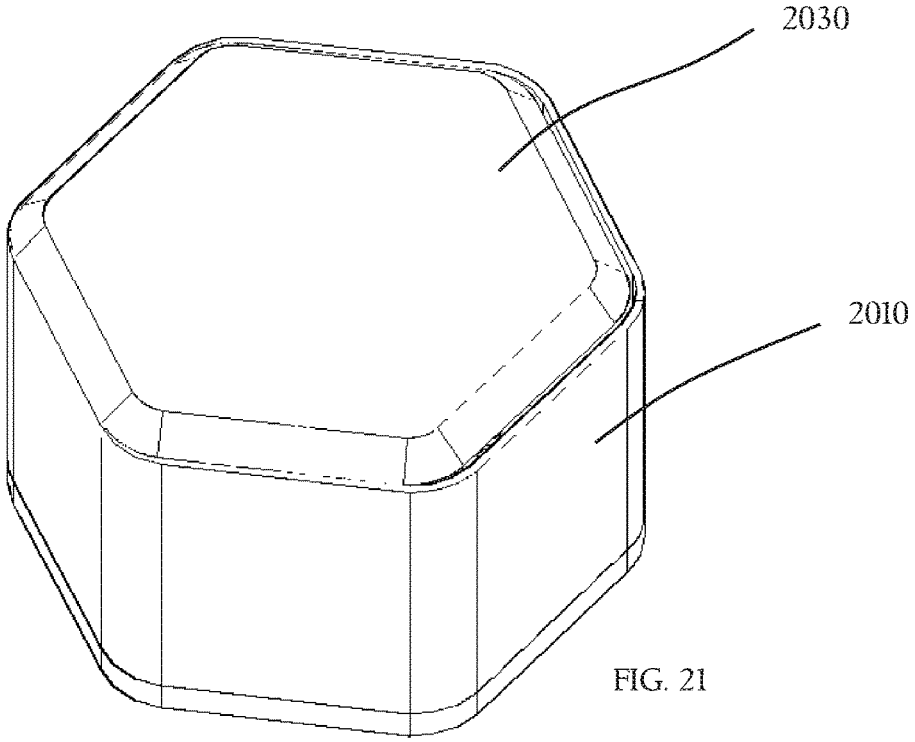
FIG. 21 is a bottom perspective view of a first embodiment hexagonal container body.

FIG. 20 illustrates a first substantially hexagonally-shaped embodiment container body 2010 having a bottom surface 2030 (illustrated by FIG. 21). Lens 2099 is shown within viewing opening 2085. In one preferred embodiment, lens 2099 is countersunk within viewing opening 2085. In an alternative, lens 2099 may be domed above viewing opening 2085. Lens 2099 may be mounted on or within viewing opening 2085 in any fashion permitting visualization through viewing opening 2085. In one embodiment, lens 2099 may be replaced with a window which provides viewing but lacks magnification power. Lid 2060 fits snugly on container body 2010 forming an airtight seal, defining chamber 2011. Plug 105, illustrated by FIGS. 1, 8, and 10, is inserted within recessed area 2090 to seal the plurality of scent openings 2095 to make chamber 2011 airtight.

Figure 22:
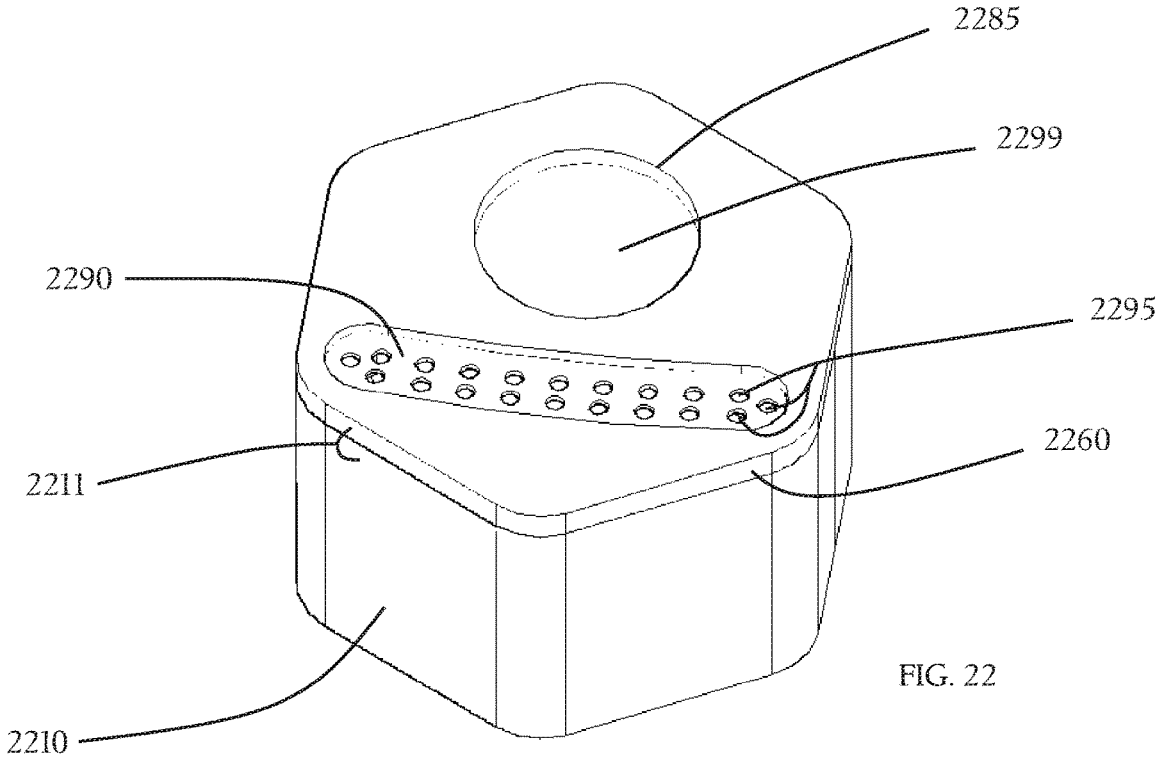
FIG. 22 is a perspective view of a second embodiment hexagonal container body.
Figure 23:
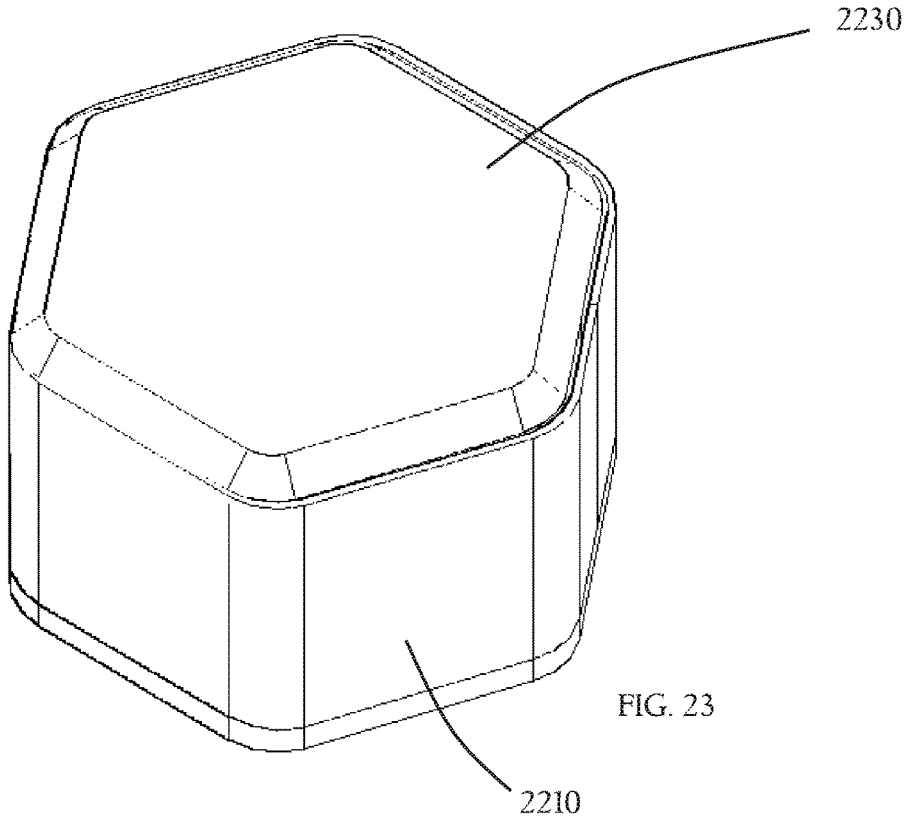
FIG. 23 is a bottom perspective view of a second embodiment hexagonal container body.

FIG. 22 illustrates a second substantially hexagonally-shaped embodiment container body 2210 having a bottom surface 2230 (illustrated by FIG. 23). Lens 2299 is shown within viewing opening 2285. In one preferred embodiment, lens 2299 is countersunk within viewing opening 2285. In an alternative, lens 2299 may be domed above viewing opening 2285. Lens 2299 may be mounted on or within viewing opening 2285 in any fashion permitting visualization through viewing opening 2285. In one embodiment, lens 2299 may be replaced with a window which provides viewing but lacks magnification power. Lid 2260 fits snugly on container body 2210 forming an airtight seal, defining chamber 2211. Plug 105, illustrated by FIGS. 1, 8, and 10, is inserted within recessed area 2290 to seal the plurality of scent openings 2295 to make chamber 2211 airtight.

Figure 24:
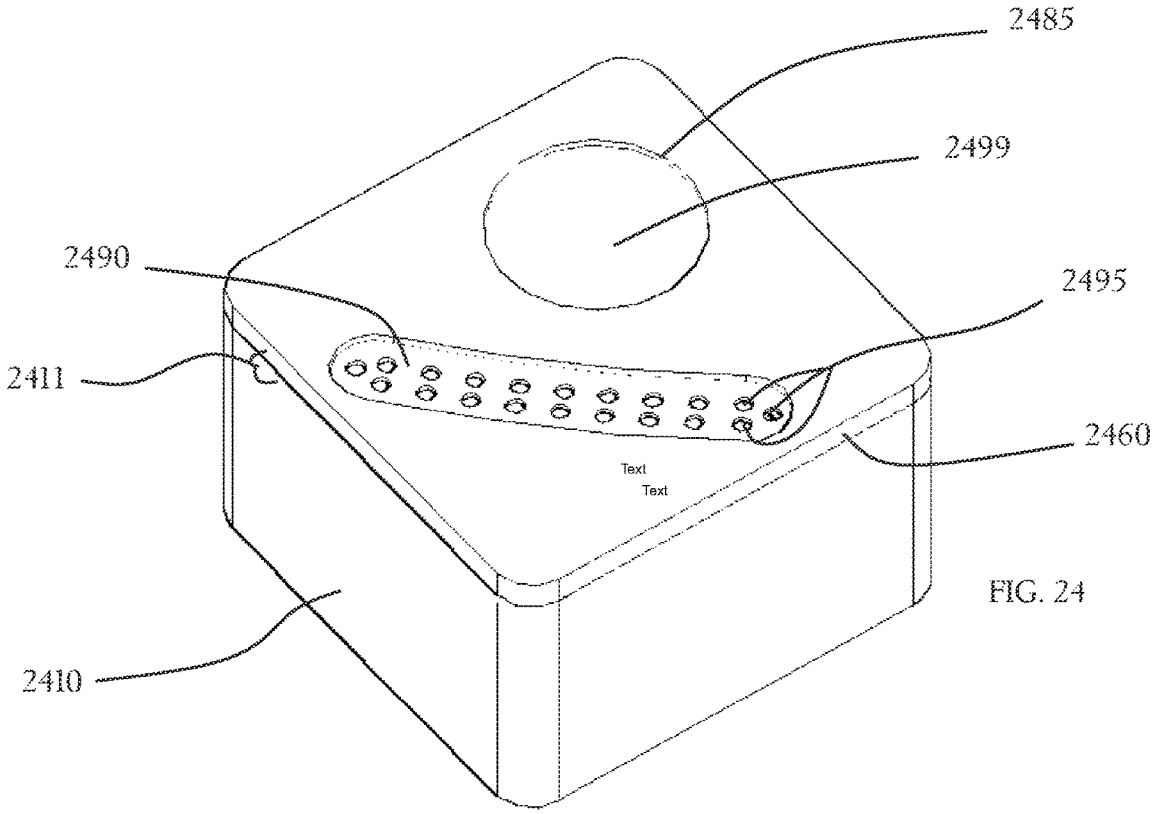
FIG. 24 is a perspective view of an embodiment diamond container body.
Figure 25:
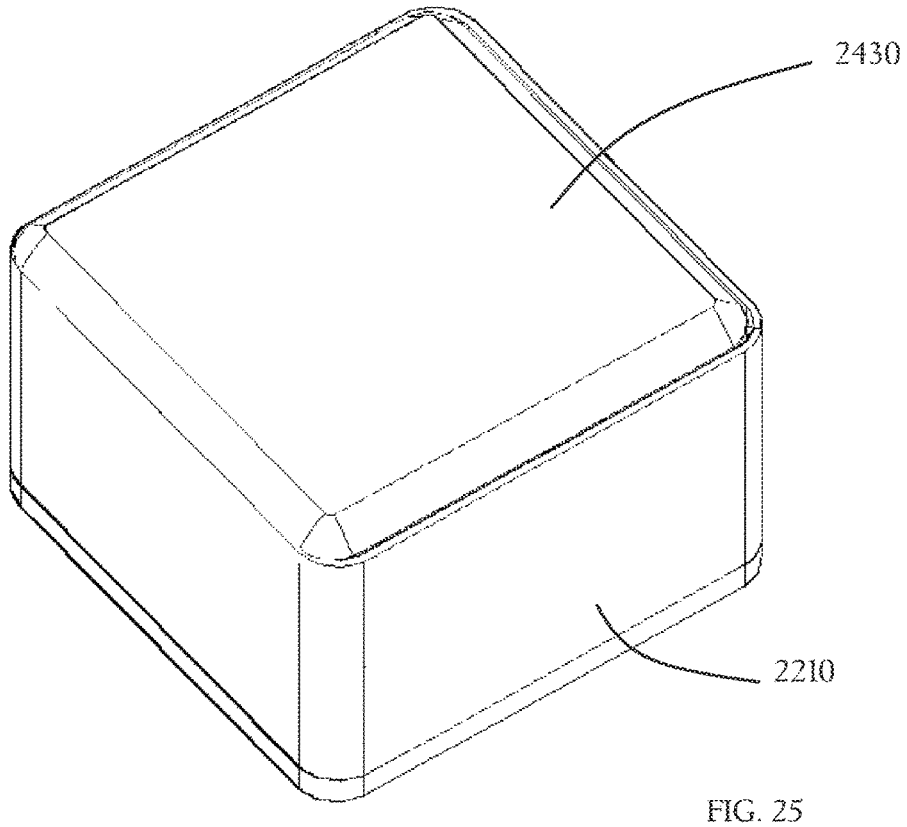
FIG. 25 is a bottom perspective view of an embodiment diamond container body.

FIG. 24 illustrates diamond-shaped embodiment container body 2410 having a bottom surface 2430 (illustrated by FIG. 25). Lens 2499 is shown within viewing opening 2485. In one preferred embodiment, lens 2499 is countersunk within viewing opening 2485. In an alternative, lens 2499 may be domed above viewing opening 2485. Lens 2499 may be mounted on or within viewing opening 2485 in any fashion permitting visualization through viewing opening 2485. In one embodiment, lens 2499 may be replaced with a window which provides viewing but lacks magnification power. Lid 2460 fits snugly on container body 2410 forming an airtight seal, defining chamber 2411. Plug 105, illustrated by FIGS. 1, 8, and 10, is inserted within recessed area 2490 to seal the plurality of scent openings 2495 to make chamber 2411 airtight.

Figure 26:
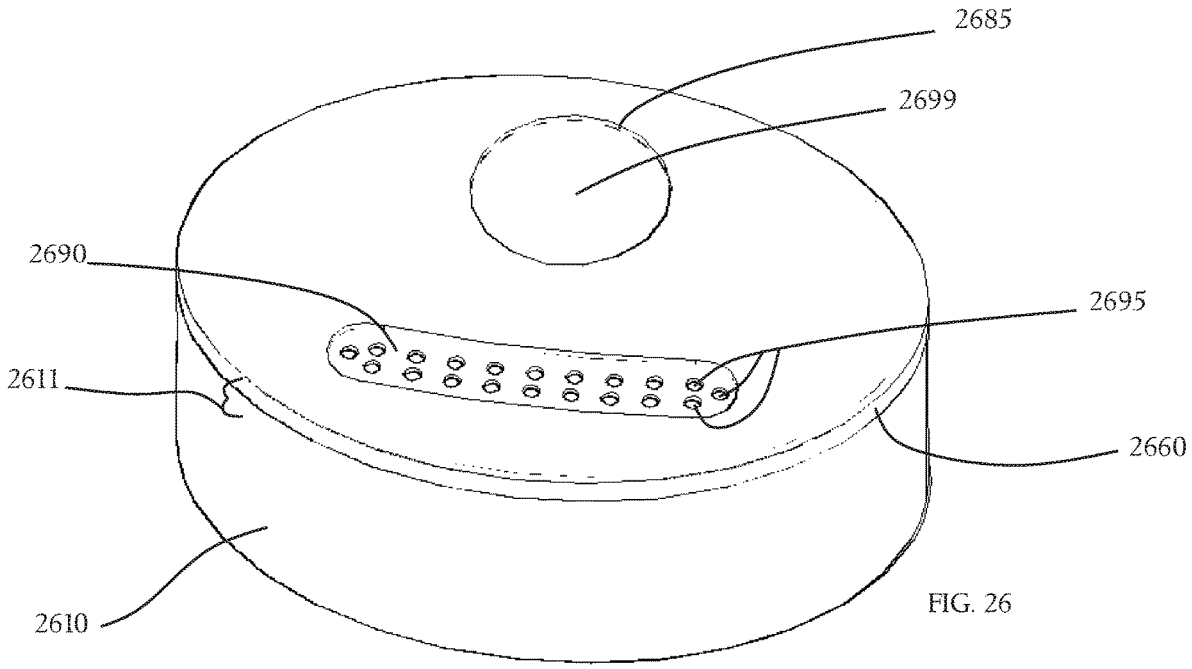
FIG. 26 is a perspective view of an embodiment oval container body.
Figure 27:
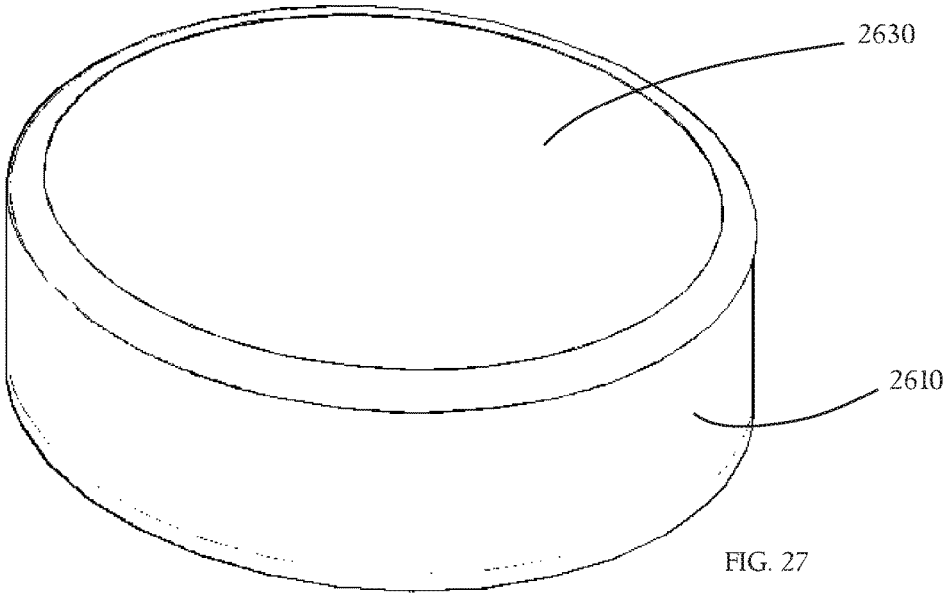
FIG. 27 is a bottom perspective view of an embodiment oval container body.

FIG. 26 illustrates an oval shaped embodiment container body 2610 having a bottom surface 2630 (illustrated by FIG. 27). Lens 2699 is shown within viewing opening 2685. In one preferred embodiment, lens 2699 is countersunk within viewing opening 2685. In an alternative, lens 2699 may be domed above viewing opening 2685. Lens 2699 may be mounted on or within viewing opening 2685 in any fashion permitting visualization through viewing opening 2685. In one embodiment, lens 2699 may be replaced with a window which provides viewing but lacks magnification power. Lid 2660 fits snugly on container body 2610 forming an airtight seal, defining chamber 2611. Plug 105, illustrated by FIGS. 1, 8, and 10, is inserted within recessed area 2690 to seal the plurality of scent openings 2695 to make chamber 2611 airtight.

Figure 28:
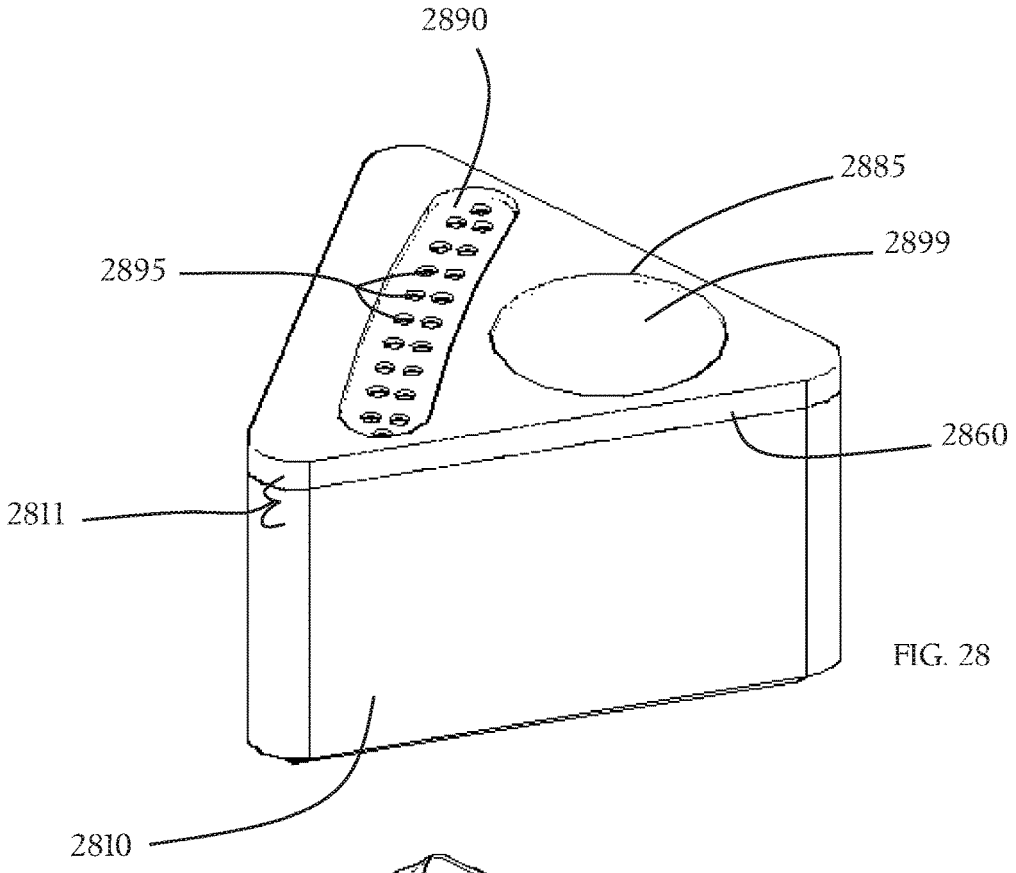
FIG. 28 is a perspective view of an embodiment triangle container body.
Figure 29:
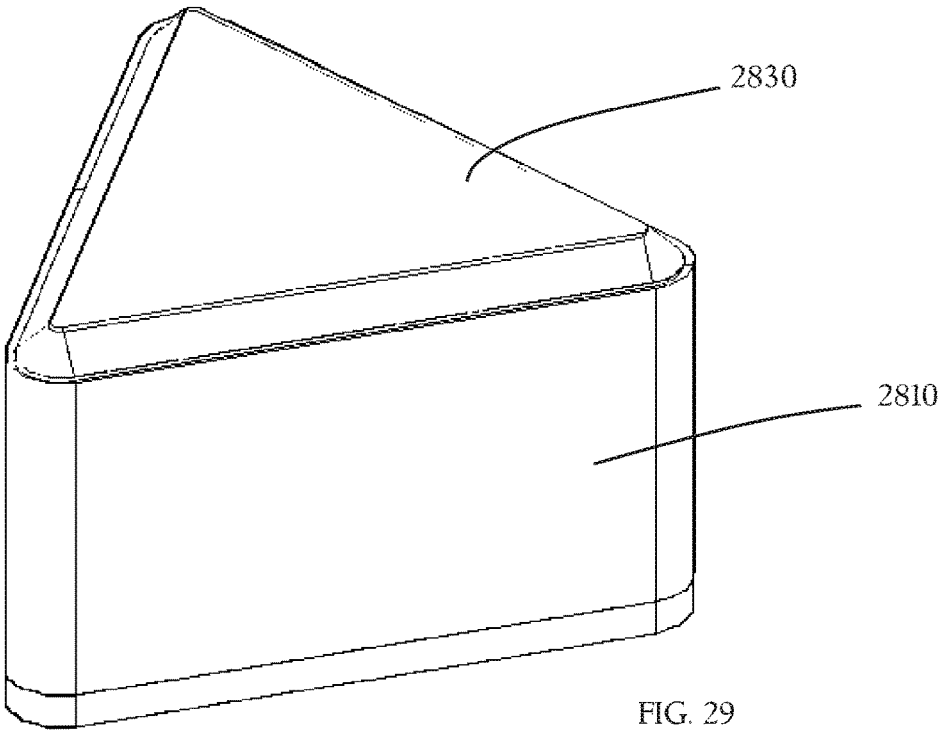
FIG. 29 is a bottom perspective view of an embodiment triangle container body.

FIG. 28 illustrates a first substantially triangle embodiment container body 2810 having a bottom surface 2830 (illustrated by FIG. 29). Lens 2899 is shown within viewing opening 2885. In one preferred embodiment, lens 2899 is countersunk within viewing opening 2885. In an alternative, lens 2899 may be domed above viewing opening 2885. Lens 2899 may be mounted on or within viewing opening 2885 in any fashion permitting visualization through viewing opening 2885. In one embodiment, lens 2899 may be replaced with a window which provides viewing but lacks magnification power. Lid 2860 fits snugly on container body 2810 forming an airtight seal, defining chamber 2811. Plug 105, illustrated by FIGS. 1, 8, and 10, is inserted within recessed area 2890 to seal the plurality of scent openings 2895 to make chamber 2811 airtight.

For illustrative purposes, mounting projection 55, described above, has not been shown in FIGS. 12-28, however, in one embodiment, any container body described herein may be shaped to define mounting projection 55 to hold a subject sample such as a botanical sample.

All lenses described in this patent application may be disposed to cover said viewing opening. Lenses may be affixed to lid 60 by snap fit, or friction fit or adhesively. Lenses forms an airtight seal between lenses and lids of various embodiments. Lenses described herein may be plano-convex lens such as Lens #90-1235 manufactured by J. P. Manufacturing. A variety of lenses may be used such as a 1×, 2×, or 3× magnifier. In an alternative embodiment, the lens is not a magnifier.

Any of the container bodies described herein may be shaped to define feet 45 as described. Any lid described herein may be shaped to define a card holder.

Tether 120 may be optionally incorporated with any embodiment container as described above.

All container bodies described herein a have an interior surface and exterior surface. All container bodies are shaped to define an open top and a bottom. All container bodies described herein are shaped to define a perimetrical ridge surrounding the open top. Further, all container bodies may be further shaped to define a mounting projection disposed on the interior of said bottom of the container bodies. In some embodiments, a container body may not be shaped to define a mounting projection, and is simply flat.

All lids described herein have an interior surface and exterior surface, wherein the lids are shaped to define a perimeter, wherein lids are shaped to define a viewing opening. All lids described herein are further shaped to define a recessed area and shaped to define a plurality of scent openings within the recessed area.

A removable soft plug may be used with all lids described herein, and shaped to fit within the recessed area forming an airtight seal.

For any given container body shape, the perimeter of the lid will correspond to the perimetrical ridge of the container body, such that the lid is fitted on the perimetrical ridge of said container body forming a chamber. The plug forms an airtight seal between said plug and said lid completely sealing a chamber of any shaped described herein.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, which are not specified within the detailed written description or illustrations contained herein yet, are considered apparent or obvious to one skilled in the art are within the scope of the present invention. Further, it should be noted that several inventive embodiments and features are disclosed together for convenience; unless specified otherwise, all embodiment inventive options disclosed herein may be used independently from each other or cooperatively together. Use of distinct reference characters is for illustrative purposes only, and the illustrated embodiment or feature may be used either cooperatively with or distinctly from any other embodiment or feature unless specified otherwise.

The following is claimed:

1. A display container for botanical samples, comprising:

a) an enclosure including a container body and a lid detachably mounted to the container body to enclose an interior chamber for storing the botanical samples, the lid including a lens for viewing of the botanical samples, and the container body including:

i. an open top covered by the lid, the open top defined by an opening through which the botanical samples are insertable into the interior chamber, ii. an interior base surface in the interior chamber opposite the opening and overtop of which the botanical samples are positionable in the interior chamber, the base surface defined by an area smaller than that of the opening, and iii. an interior sidewall surface extending in the interior chamber between an upper end circumscribing the opening and a lower end adjoining a periphery of the base surface, at least a lower portion of the interior sidewall surface sloping downwardly and horizontally inwardly to the base surface for directing loose botanical samples toward the base surface;

b) one or more scent ports extending through the lid between the interior chamber and an outside environment; and c) a port blocking member attached to the lid, the port blocking member movable between a closed position in which the one or more scent ports are blocked by the port blocking member, and an open position in which the scent ports are unblocked for sampling an aroma of the botanical samples, wherein the lens defines an optical axis, the optical axis intersecting the base surface.

2. The display container of claim 1, wherein the lens is offset from a centerpoint of the lid.

3. The display container of claim 1, wherein the base surface is generally planar.

4. The display container of claim 1, wherein the container body has a ridge portion circumscribing the opening, and the lid is mounted over the ridge portion.

5. The display container of claim 4, wherein the lid has a top wall extending over the interior chamber and a sidewall extending downwardly from an outer periphery of the top wall and along an exterior of the ridge portion.

6. The display container of claim 1, wherein the lid and the container body are formed of a transparent polymeric material.

7. The display container of claim 1, wherein each of the container body and the lid is of unitary construction.

* * * * *